US007494121B2

(12) United States Patent
Herrmann et al.

(10) Patent No.: US 7,494,121 B2
(45) Date of Patent: Feb. 24, 2009

(54) AUTOMATICALLY VARIABLY SHAPED SHEET STACKING TRAY SURFACE FOR PRINTED SHEETS

(75) Inventors: Douglas K. Herrmann, Webster, NY (US); Richard P. Ficarra, Macedon, NY (US); Tina M. Burns, Rochester, NY (US); Bruce D. Caryl, Fairport, NY (US); Robert F. Rubscha, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 480 days.

(21) Appl. No.: 11/370,509

(22) Filed: Mar. 7, 2006

(65) Prior Publication Data

US 2007/0210509 A1 Sep. 13, 2007

(51) Int. Cl.
*B65H 31/00* (2006.01)

(52) U.S. Cl. ..... 271/207; 271/209; 271/220

(58) Field of Classification Search ..... 271/207, 271/209, 220
See application file for complete search history.

(56) References Cited

U.S. PATENT DOCUMENTS 4,982,945 A 1/1991 Marasco et al.
5,737,987 A 4/1998 Olson et al.
5,975,521 A * 11/1999 Ono et al. ..... 271/188
6,065,747 A * 5/2000 Khovaylo et al. ..... 271/209
6,478,296 B1 * 11/2002 Jensen et al. ..... 271/209
6,819,906 B1 11/2004 Herrmann et al.
2003/0107166 A1 * 6/2003 Cost et al. ..... 271/177

* cited by examiner

*Primary Examiner*—David H Bollinger
(74) *Attorney, Agent, or Firm*—Fay Sharpe LLP

(57) ABSTRACT

A system and method of stacking printed sheets with sheet curl stacking problems in an automatically variable configuration stacking system having a spaced array of repositionable initial sheet supporting surfaces providing a generally planar initial stack supporting configuration on which a limited amount of sheets initially stack, and then, in response to stacking additional sheets in said system, the stacking system automatically changes to a different, arcuate, stack supporting configuration by automatically lowering at least some of the spaced array of initial sheet supporting surfaces to arcuately bend the curled sheets in an arcuate direction transverse the sheet curl direction on a fixed stacking surface that is arcuate transversely of the sheet curl direction.

19 Claims, 5 Drawing Sheets

AUTOMATICALLY VARIABLY SHAPED SHEET STACKING TRAY SURFACE FOR PRINTED SHEETS

Figure 1:
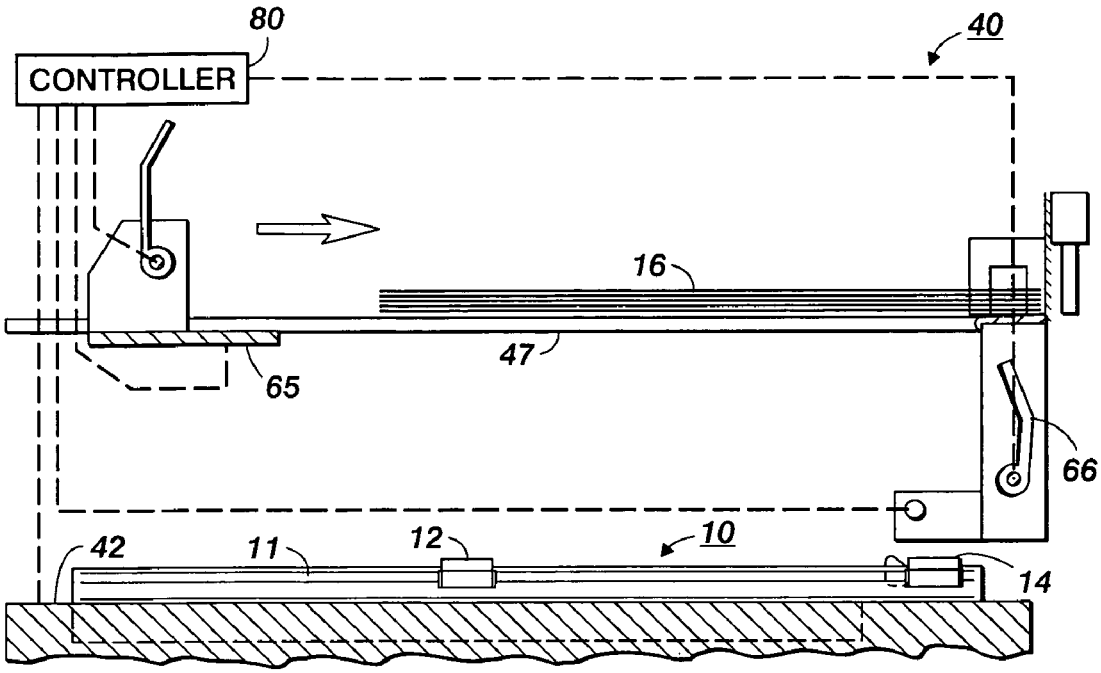

Cross-referenced and incorporated by reference is commonly owned U.S. Pat. No 6,819,906 B1, issued Nov. 16, 2004, by Douglas K. Herrmann, et al, entitled PRINTER OUTPUT SETS COMPILER TO STACKER SYSTEM. The present invention can provide an improvement in the reliability of the sheet stacking system disclosed therein for print media sheets outputted from a printer into said system with sheet curl, although it is not limited thereto.

By way of further background, examples of different kinds of variable configuration sheet stacking trays are disclosed in Xerox Corp. U.S. Pat. No. 5,737,987 issued Apr. 14, 1998 and U.S. Pat. No. 4,982,945 issued Jan. 8, 1991.

The system and method of the embodiment example disclosed herein can, for example, reduce the stacking height buildup of curled print media sheets, allowing for more sheets to be effectively stacked, and/or avoid erroneous readings from stack height sensors, or interference with other components such as tamping or compiling operations, etc. It can be relatively independent of sheet size. By effectively automatically changing the shape of the stacking tray sheet stacking surface from approximately flat for thin or lighter weight stacks to substantially arcuately curved for cumulatively thicker or heavier stacks in the exemplary embodiment, with the arcuate curve being transverse the sheet curl direction, the beam strength of the now transversely curved sheets may significantly reduce the initial sheet curl in the transverse direction of the stacked sheets.

One feature of the embodiments disclosed herein comprises An improved sheets stacking system for stacking a multiplicity of flimsy print media sheets with reduced curled sheets stacking problems, comprising an automatically variable configuration sheet stacking tray system having a rigidly arcuately shaped sheet stack supporting surface area and a spaced plurality of repositionable sheet supporting members normally upstanding over areas of said rigidly arcuately shaped sheet stack supporting surface area to define a first sheet stack supporting surface which is substantially more planar than said rigidly arcuately shaped sheet stack supporting surface area, said automatically variable configuration sheet stacking tray system supporting a preset limited amount of said flimsy print media sheets stacked on said repositionable sheet supporting members above at least the majority of said rigidly arcuately shaped sheet stack supporting surface area in a stacking configuration thereof which is substantially more planar than said arcuate shape of said rigidly arcuately shaped sheet stack supporting surface area, said repositionable sheet supporting members being automatically repositionable downwardly towards said rigidly arcuately shaped sheet stack supporting surface area in response to an amount of said flimsy print media sheets being stacked on top of said repositionable sheet supporting members in excess of said preset limited amount thereof, to thereby automatically vary the stack supporting configuration of said automatically variable configuration sheet stacking tray system towards said rigidly arcuately shaped sheet stack supporting surface area.

Further specific features disclosed in the embodiments herein, individually or in combination, include those wherein said plurality of repositionable sheet supporting members are spring loaded upwardly over areas of said rigidly arcuately shaped sheet stack supporting surface area and repositionable downwardly towards said rigidly arcuately shaped sheet stacking supporting surface area in response to a preset weight of said flimsy print media sheets stacking thereon; and/or wherein said plurality of repositionable sheet supporting members are repositionable downwardly towards said arcuately shaped rigid sheet stack supporting surface area in response approximately 50 to 200 of said flimsy print media sheets stacking on top of said repositionable sheet supporting members; and/or wherein said automatically variable configuration sheet stacking tray system has a sheet edges stacking position therein and further includes a movable sheet clamping system for automatically pressing down said flimsy print media sheets being stacked in said automatically variable configuration sheet stacking tray system adjacent to said sheet edges stacking position; and/or wherein said automatically variable configuration sheet stacking tray system has a sheet edges stacking position therein, and wherein at least two of said repositionable sheet supporting members are positioned adjacent to said sheet edges stacking position; and/or wherein said automatically variable configuration sheet stacking tray system has a first sheet edges stacking position therein, and further includes a sheet clamping system for automatically pressing down said flimsy print media sheets being stacked in said automatically variable configuration sheet stacking tray adjacent to said first sheet edges stacking position, and wherein at least two said repositionable sheet supporting members are positioned adjacent to said first sheet lead edges stacking position, and wherein at least two additional said repositionable sheet supporting members are positioned intermediately of said automatically variable configuration sheet stacking tray system; and/or wherein said at least two said repositionable sheet supporting members are spring loaded to be repositionable downwardly towards said rigidly arcuately shaped sheet stack supporting surface area by overcoming a preset spring force, and wherein said movable sheet clamping system for automatically pressing down said flimsy print media sheets being stacked adjacent to said first sheet edges stacking position has a pressing force which is less than said preset spring force of said at least two repositionable sheet supporting members; and/or an improved sheets stacking system for stacking a multiplicity of flimsy print media sheets with reduced stacking problems for curled sheets having a sheet curl axis, comprising an automatically variable configuration sheet stacking tray system having a substantially arcuate sheet stack supporting surface which is arcuate transversely of said sheet curl axis, and at least two spring loaded repositionable sheet stack supporting surface members spring loaded upwardly to define an initial generally planar sheet stack supporting surface by extending above the majority of said arcuate sheet stack supporting surface to define an initial sheet stack supporting surface with said repositionable sheet stack supporting surface members which is substantially more planar than said arcuate sheet stack supporting surface for supporting a preset limited amount of said flimsy printed print media sheets stacked on said repositionable sheet stack supporting surface members, said repositionable sheet stack supporting members being automatically repositionable downwardly towards said arcuate sheet stack supporting surface in response to an amount of said flimsy printed print media sheets being stacked on said repositionable sheet supporting members in excess of said preset limited amount thereof to thereby automatically vary the stack supporting configuration of said automatically variable configuration sheet stacking tray system towards said arcuate sheet stacking supporting surface transversely of said sheet curl axis; and/or wherein said repositionable sheet stack supporting members are automatically depressed downwardly towards said arcuate sheet stack supporting surface by an overlying stack of said sheets weighing in excess of a preset weight; and/or wherein said sheets stacking system includes downwardly movable sheet stacking assistance members and at least two said repositionable sheet supporting members positioned under said downwardly movable sheet stacking assistance members; and/or wherein said substantially arcuate sheet stack supporting surface is semi-cylindrical with a central ridge running transversely of said sheet curl axis providing a portion of said initial generally planar sheet stack supporting surface; and/or wherein said substantially arcuate sheet stack supporting surface is semi-cylindrical with a central ridge running transversely of said sheet curl axis and providing a portion of said initial generally planar sheet stack supporting surface, and wherein at least four said repositionable sheet supporting members in approximately the same plane as said central ridge; and/or wherein said repositionable sheet supporting members extend upwardly through apertures in said substantially arcuate sheet stack supporting surface; and/or an improved method of stacking a multiplicity of flimsy print media sheets on a sheet stacking surface with at least some of said sheets having sheet curl in a sheet curl direction; comprising automatically changing the effective shape of said sheet stacking surface from a first approximately planar stack supporting shape for an initially stacked amount of said flimsy print media sheets to a second and substantially arcuately curved stack supporting shape for a second and substantially greater stacked amount of said flimsy print media sheets, said second arcuately curved stack supporting shape extending transversely of said sheet curl direction so as to arcuately deform said second and substantially greater stacked amount of said flimsy print media sheets transversely of said sheet curl direction to significantly reduce the total amount of said sheet curl in said substantially greater stacked amount of said flimsy print media sheets; and/or a method of stacking flimsy sheets presenting stacking problems for curled sheets comprising stacking said sheets in an automatically variable configuration stacking system having a spaced plurality of upstanding repositionable initial sheet supporting surfaces providing a roughly planar initial stack supporting configuration, stacking an initial limited amount of said sheets on at least some of said plurality of upstanding repositionable initial sheet supporting surfaces, and then, in response to stacking additional said sheets in said automatically variable configuration stacking system in excess of said initial limited amount of said sheets, automatically changing said automatically variable configuration stacking system to a different, arcuate, stack supporting configuration by automatically lowering at least some of said plurality of upstanding repositionable initial sheet supporting surfaces to arcuately bend said stacked sheets in an arcuate direction transversely of the direction of sheet curl; and/or an improved method of stacking a multiplicity of flimsy print media sheets outputted from a printer as printed sheets with sheet curl, comprising stacking said flimsy printed print media sheets into an automatically variable configuration stacking system, stacking a preset initial limited amount of said flimsy printed print media sheets in said automatically variable configuration stacking system on top of a generally planar spaced array of plural repositionable sheet supporting surfaces in said automatically variable configuration stacking system, in response to stacking additional said flimsy printed print media sheets in said automatically variable configuration stacking system substantially in excess of said preset initial limited amount of said flimsy printed print media sheets, automatically changing said automatically variable configuration stacking system to an arcuate stack supporting surface configuration by automatically lowering at least some of said spaced array of plural repositionable sheet supporting surfaces; and/or wherein said spaced array of plural repositionable sheet supporting surfaces automatically depress towards an underlying arcuately shaped rigid sheet supporting surface area of said automatically variable configuration stacking system to bend said flimsy printed print media sheets stacked thereon substantially into said arcuate shape of an arcuately shaped rigid sheet supporting surface area; and/or wherein said spaced array of plural repositionable sheet supporting surfaces are spring loaded to automatically depress towards an underlying arcuately shaped rigid sheet supporting surface area of said automatically variable configuration stacking system to bend said flimsy printed print media sheets stacked thereon substantially into said arcuate shape of substantially underlying arcuately shaped rigid sheet supporting surface areas of said variable configuration stacking system by the weight of said stacking of said flimsy printed print media sheets in said automatically variable configuration stacking system substantially in excess of a preset initial limited stack weight of said flimsy printed print media sheets; and/or wherein said flimsy printed print media sheets are fed into said automatically variable stacking system with sheet curl in a first direction, and wherein said automatically variable stacking system has an arcuately shaped rigid sheet supporting surface area which is arcuately shaped transversely of said first direction, and wherein said spaced array of plural repositionable sheet supporting surfaces extend transversely of said arcuately shaped sheet supporting surface area to be normally at least partially spaced above said arcuately shaped rigid sheet supporting surface area, and said spaced array of plural repositionable sheet supporting surfaces are automatically depressed in response to said stacking thereon of said flimsy printed print media sheets substantially exceeding said preset limited initial amount of said flimsy printed print media sheets to form an arcuately shaped stack supporting surface which is arcuate transversely of said first direction of sheet curl to bend with gravity said stacked printed print media sheets towards said rigidly arcuately shaped rigid sheet stacking supporting surface area; and/or wherein said automatically variable configuration sheet stacking tray has a first sheet edges stacking position therein, and further includes a movable sheet clamping system for automatically pressing down said flimsy printed print media sheets adjacent to said first sheet edges stacking position, and wherein at least two of said repositionable sheet supporting surfaces are positioned adjacent to said first sheet edges stacking position.

The term "reproduction apparatus" or "printer" as used herein broadly encompasses various printers, copiers or multifunction machines or systems, xerographic or otherwise, unless otherwise defined in a claim. The term "sheet" herein refers to a physical sheet of paper, plastic, or other suitable physical imaging substrate, whether precut or web fed. The term "flimsy" sheets herein generally refers to, but is not limited to, normal basis weight paper sheets of print media subject to curling or bending with relatively low forces. Such normal printed sheets are capable of a limited beam strength, which can be substantially increased in one axis if the sheet is arcuately curved in the orthogonal axis.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings or actuations illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
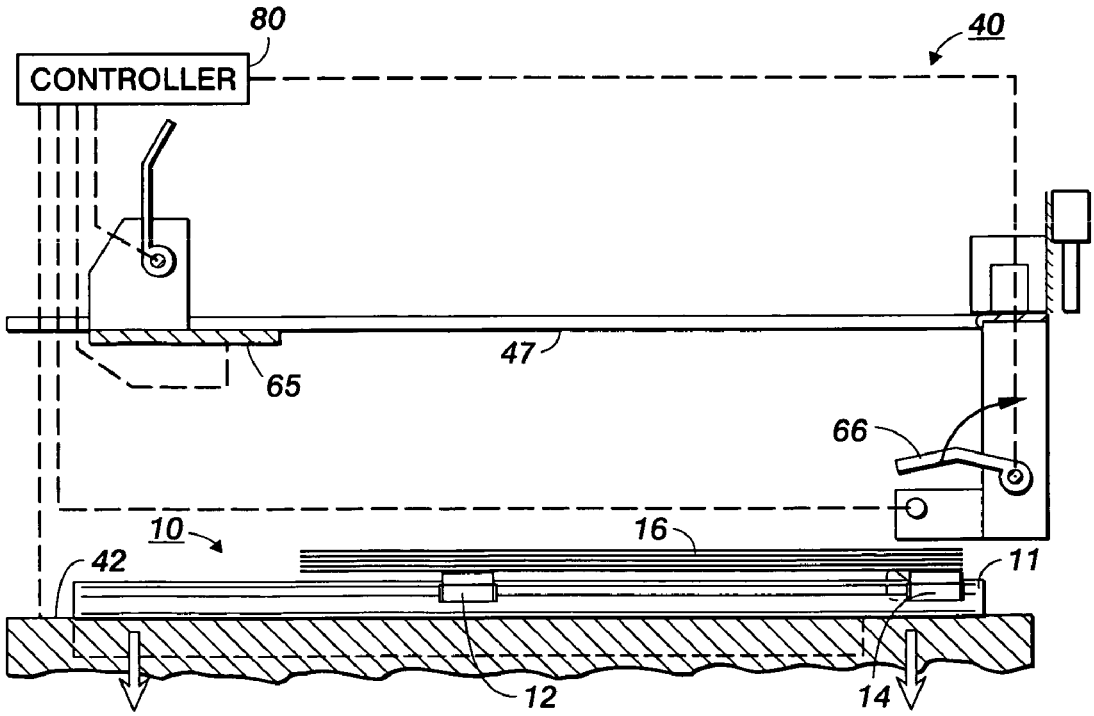
Figure 3:
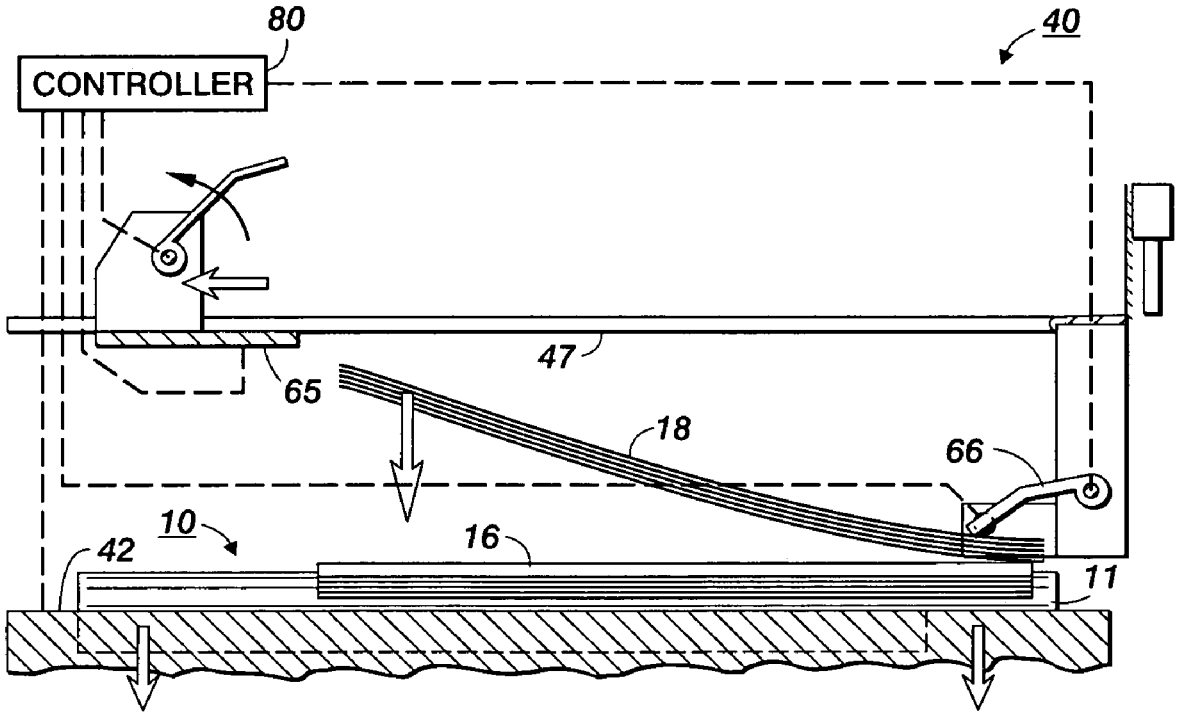
Figure 4:
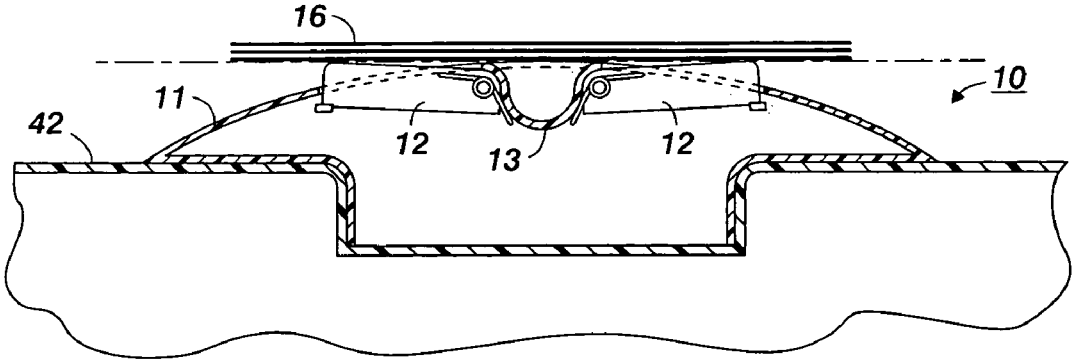
Figure 5:
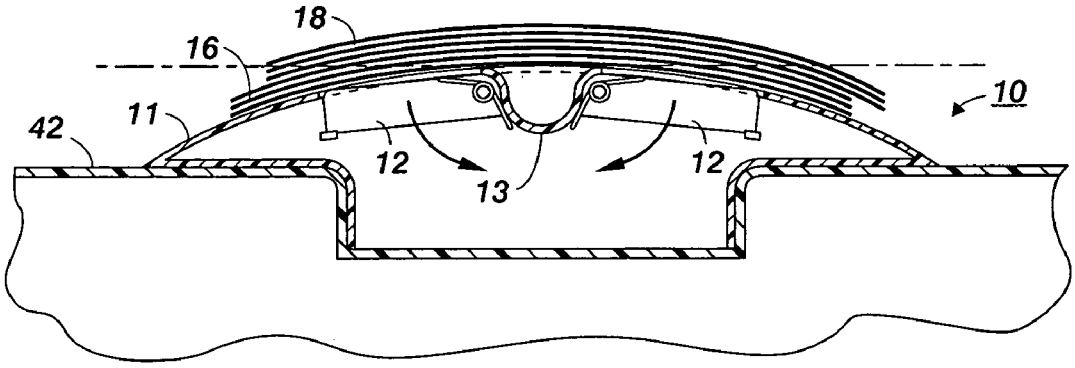
Figure 6:
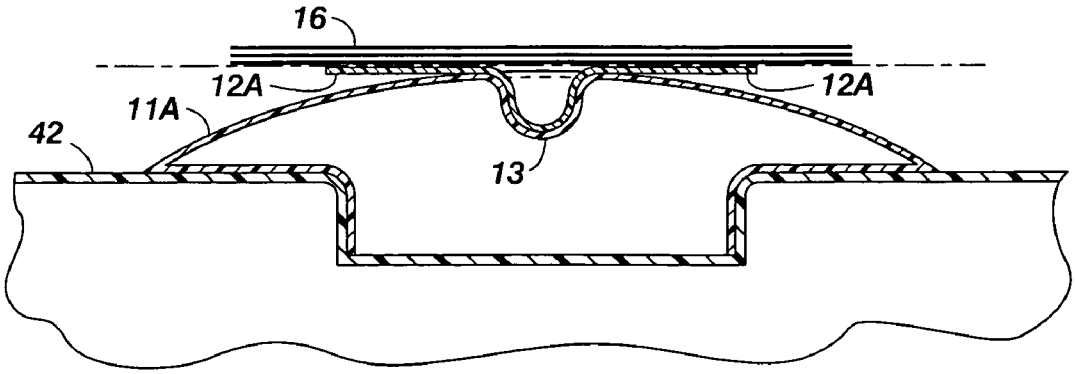
Figure 7:
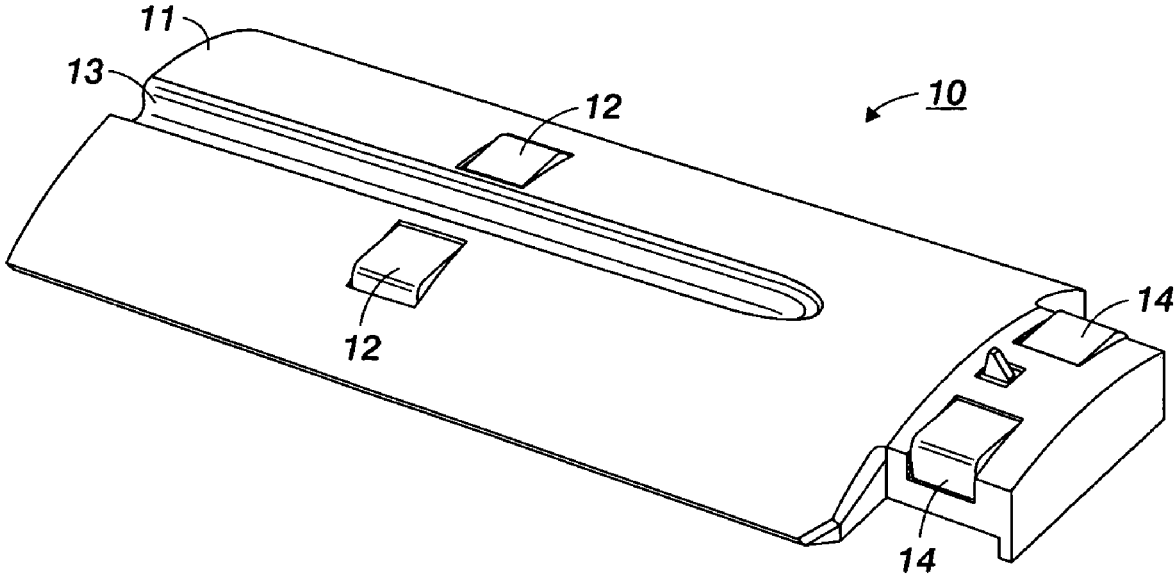
Figure 8:
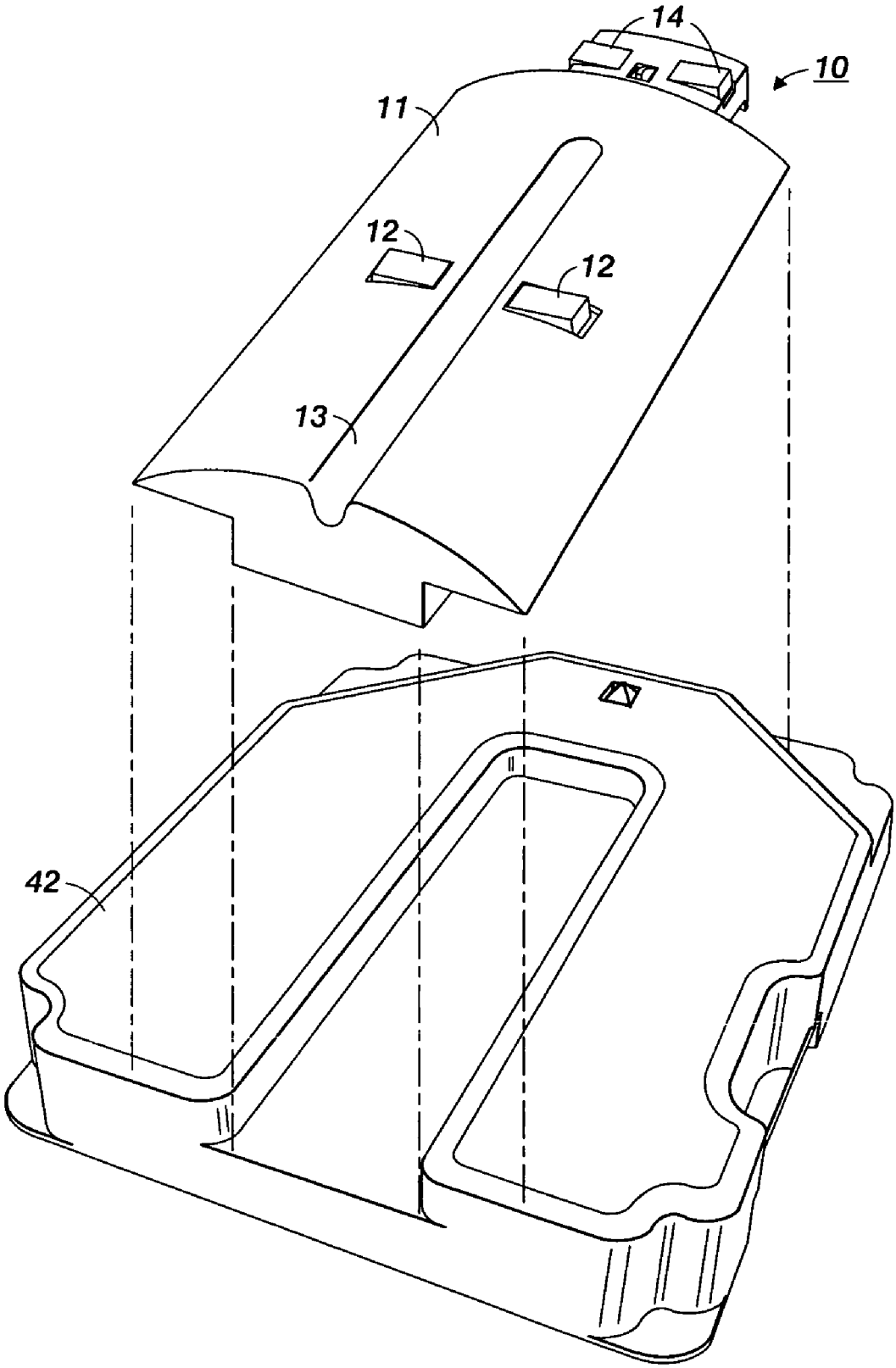

Various of the above-mentioned and further features and advantages will be apparent to those skilled in the art from the specific apparatus and its operation or methods described in the examples below, and the claims. Thus, they will be better understood from this description of these specific embodiments, including the drawing figures (which are approximately to scale) wherein:

FIGS. 1-3 are a frontal view of an exemplary printed sheets combined compiler/stacker system, showing that apparatus in sequential stages of operation as described in the above cross-referenced prior U.S. Pat. No. 6,819,906 B1 issued Nov. 16, 2004, and here additionally showing how one example of the subject variable configuration stacking tray may be placed therein for stacking improvements;

FIGS. 4 and 5 are cross-sectional partial views of the FIGS. 1-3 example of a variable configuration stacking tray, shown in two different operating configurations thereof due to two different amounts of accumulated sheet stack weight thereon;

FIG. 6 similarly shows a similar but different embodiment of the variable configuration stacking tray of FIGS. 4 and 5;

FIG. 7 is a perspective view of the variable configuration stacking tray of FIGS. 4 and 5; and FIG. 8 is an exploded perspective view of the variable configuration stacking tray of FIGS. 4 and 5, further illustrating how it can be simply placed on top of the existing prior stacking tray as in FIGS. 1, 2, 3, 4 and 5.

Describing now in further detail the exemplary embodiments with reference to the Figures, there are shown two examples 11 and 11A of an improved sheet stacking tray for a sheet stacking system 10 providing a dual mode, automatically dual configuration, sheet supporting and stacking tray 11 or 11A. (The second or alternative embodiment tray 11A shown here in FIG. 6 has a unitary spring member 12A mounted on the tray 11A.) Either may be a unitary stacking tray insert that can be interchanged with existing normal stacking trays, or simply superposed on top of an existing stacking tray as particularly illustrated in FIG. 8. These exemplary dual mode stacking trays 11 or 11A can automatically change their stack-supporting shape as the paper stack grows to reduce the effects of cumulative sheet curl. This is particularly shown by a comparison of FIGS. 4 and 5 for the stacking tray 11.

When the first few curled sheets are placed onto this stacking tray 11, its stacking surface simulates a substantially flat surface, as in FIG. 4, so that lighter sheets/smaller sets can stack smoothly. This is accomplished in this example by two spaced apart pairs of upwardly spring loaded members 12 and 14, also shown in FIGS. 7 and 8, defining four spaced sheet supporting areas under the stacking sheets in a substantially horizontal plane projecting above most of the actual surface of the tray 11 for stacking such initial or small stacks. Alternatively, this may be defined by the initial substantially horizontal position of the projecting legs of the unitary spring 12A of FIG. 6.

However, as the sheet stack grows, as in FIG. 5, it becomes desirable to minimize the cumulative increasing sheet curl thereof. his is automatically actively accomplished by causing the effective stacking tray stacking surface to change and take on a substantially curved shape, curved in a direction substantially perpendicular to the curve of the sheet curls. That is provided by the underlying fixed surface configuration of the trays 11 or 11A. By effectively changing the shape of the stack supporting tray surface from flat to curved, the beam strength of the paper is changed orthogonally to the axis of the supporting curve, so that previous sheet curl is significantly reduced, thus allowing for higher stacks to be more easily or safely created.

This varying of the effective stacking tray shape during sheet stacking has been found to be particularly desirable, for example, for lightweight sheets and/or small sets of sheets which have a tendency to kink when initially stacked on an initially curved tray. That can especially be a problem when clamping or downward tamping forces are present. For example, the set clamping system of the compiler/stacker system 40 of FIGS. 1-3 in which a first document set 16 is compiled on supports 47, clamped at 65, dropped to another set of (lead edge) clamps 66, and stacked on a stacking tray 42. Then, as in FIG. 3, another document set 18 is similarly stacked on top of the first set 16, and so on, all under the control of a controller 80, as described in said U.S. Pat. No. 6,819,906 B1. However, excessive cumulative curl sheet stacking build-ups can occur with a normal or flat tray such as 42 as the stack grows.

The disclosed embodiments can solve both problems in the same stacking tray by automatically varying the shape of the tray from flat to curved as the stack height grows. The specific illustrated designs provide a floating flat surface provided by upstanding but downwardly movable spaced minor sheet supporting members, such as the illustrated upwardly spring loaded tabs 12 and 14 normally projecting above a rigid curved tray base 11.

As may be seen, the upper surface shape of this tray 11 in this example is smoothly semi-cylindrically rounded, with the highest level or "hump" thereof extending centrally along the tray 11, in the process direction. [For illustrative convenience, FIG. 5 shows the sheet sets in an alternative cross process direction of offset, rather than a process direction offset.] However, as illustrated, this central arcuate high area of the trays 11 or 11A may optionally have a relatively small groove or trench 13 extending for most of its length for conventionally providing finger access for users under the stacked sheets for convenient stack lifting and removal. Thus, the stack supporting high points of the trays 11 and 11A are central the trays along the opposite sides of the groove 11 The two pairs of spring loaded tabs 12 and 14 here, when not depressed, extend from apertures in the tray 11 surface on opposite sides of, and in the tangential plane of (aligned with) this central highest level or hump of the tray 11 surface. The transversely spaced pair of tabs 14 here are placed approximately under the downward movement location of the pair of clamps 66 here at one end of the tray 11. These clamps may be simple downward tampers in alternative stacking systems. The transversely spaced pair of tabs 12 are positioned more centrally of the tray 11 for the initial support of sets of longer sheets, to help keep such longer sheets flat, especially lighter weight sheets. Sheets shorter than normal letter size sheets need only be supported on the repositionable tab supporting surfaces 14. Thus, longer, lighter weight, sheet stacks can be supported substantially planarly on all 4 spaced tabs 12 and 14 as well as the central high spine of the tray 11, and then transition downwardly, as the stack weight increases with more stacked sheets, into the tray 11 top surface, to impart that tray 11 fixed curved top surface configuration to the overlying stacked sheets. In the alternate embodiment of FIG. 6, the initially substantially horizontally extending cantilevered spring arms of the springs 12A may be centrally mounted to tray 11A as shown, in two different locations, so as to extend to stack supporting locations similar to those of the tabs 12 and 14. These cantilevered spring arms of the springs 12A can bend downwardly to the curved tray 11A surface with increasing stack height (and thus increasing stack weight) to provide a similar function. The springs 12A may be flat or centrally contoured into the groove 13 as shown in FIG. 6.

The tray 11 or 11A is not limited to this specific disclosed configuration or mechanisms. For example, the appropriate movement of these tabs 12 and 14 to change the effective tray 11 stack supporting configuration from substantially flat to substantially curved could be controlled by mechanisms other than the illustrated springs. The active shape control could use solenoids, motors or other electromechanical means, or different spring designs. Also, for example, activation of the tray shape change could be based on the stacking elevator position, or sensed stack height or set thickness, instead of cumulative total stack weight.

The spring loading of the tabs 12 and 14 or the cantilevered spring fingers 11A may be pre-set to provide their described repositioning downward under an estimated approximately 50 to 200 sheets stacked thereon. This may vary with the particular stacking system, the amount of sheet curl, and other factors such as paper weight, paper length, and paper type (e.g., coated versus uncoated paper).

As noted, the compiler/stacker 40 of the above-cited U.S. Pat. No. 6,819,906 B1 was found to have some difficulties in handling certain print media substrates due to the amount of curled sheets accumulating on the stack. Curl of the printed sheets outputted by a printer is a longstanding stacking problem in general, especially for up-curl. Sheet curl can be due to the effect of the accumulated printing ink or toner on one side of the sheet, and/or the effects of heat, moisture, and/or roller pressure, as in a xerographic thermal roll fuser, etc., and may not even be fully overcome in the stacking position even with active upstream sheet decurler mechanisms. A stacking system with a stack that reaches an excessive curl level can cause the stacking system to shut down prematurely. For example, stack height curl sensors in the stacker may trigger a shutdown if these sensors detect curl levels that may interfere with the further sheet stacking process.

To recap, when the first few sets of sheets (one, two, or more, depending on the set thickness) are placed onto the stacking tray, the subject dual mode tray system shape simulates a flat stack supporting surface, so that these lighter sheets/smaller sets can stack smoothly. However, as the stack grows it becomes important to minimize the cumulative curl in the cumulative stacking of more curled sheets by controlling the stack configuration more aggressively. Here, this is accomplished by making the stack supporting tray surface change to take on a substantially curved shape.

By changing the effective shape of the stacking tray from flat to curved, the beam of the paper is effectively broken or transversely changed orthogonally and the sheet curl is significantly reduced, allowing for higher stacks to be safely created. However, an initially substantially planar effective tray shape is desired during initial sheet stacking because if a curved tray supporting surface would be encountered by those first sheet sets with curled sheets, they might have a tendency to kink as their beam is broken. Especially for light-weight sheets and/or small sheet sets. The disclosed embodiments can address both problems, excessive cumulative sheet stack curl and early kinking of small sets, by effectively automatically varying the shape of the tray from substantially flat to significantly curved as the stack height grows.

The disclosed variable shaped tray is aligned in the process direction, underlying the stack being created in the stacking system. That is, the underlying arcuate curved fixed surface is arcuate about an axis extending in the process direction, which is the direction that the sheets are being feed into the stacking system here. That is often the direction in which the sheets are being fed through the printer, which is the direction the sheets are acquiring their curl, but that may differ in some systems from the direction the sheets are fed into the stacking system. In any case, the desire is vary the tray shape from flat to curved transversely of the sheet curl direction, to reduce the effect of cumulative curl in the sheets as the stack grows.

As noted, when the stack is small the tray desirably simulates a flat surface. This can eliminate kinking issues associated with corrugating lightweight sheets/sets, such as by downwardly stack engaging tampers or clamps. In the particular plural sheet sets compiling and stacking system disclosed in the example of the above-cited U.S. Pat. No. 6,819,906 B1, as show in FIGS. 1-3 here, during the controlled dropping process of a compiled set onto the stacker tray the set is clamped at one side. The other side of that clamped compiled set then needs to completely roll out onto the stacking tray. If the tray is curved, a kink can form in that process in a small set of, for example, only two or three sheets, stopping those sheets from properly laying on the tray. That can cause those kinked sheets to stick up, which can lead to a stacking fault signal and a shutdown.

The disclosed embodiments allow for the smooth stacking of even such lightweight substrates even under the above or various other special stacking system constraints, even sheets with significant curl. Yet, as the stack grows and more curl control is desired or needed, automatically reducing total stack sheet curl. These disclosed embodiments can provide for the reduction of curled sheets buildup on the stack substantially independent of differences in sheet size, and without interfering with any of said tamping or compiling operations or other mechanisms, to achieve greater stacking capacity and lower rates of shutdown faults.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A sheets stacking system for stacking a multiplicity of flimsy print media sheets with reduced curled sheets stacking problems, comprising:

an automatically variable configuration sheet stacking tray system having a rigidly arcuately shaped sheet stack supporting surface area and a spaced plurality of repositionable sheet supporting members normally upstanding over areas of said rigidly arcuately shaped sheet stack supporting surface area to define a first sheet stack supporting surface which is substantially more planar than said rigidly arcuately shaped sheet stack supporting surface area, said automatically variable configuration sheet stacking tray system supporting a preset limited amount of said flimsy print media sheets stacked on said repositionable sheet supporting members above at least the majority of said rigidly arcuately shaped sheet stack supporting surface area in a stacking configuration thereof which is substantially more planar than said arcuate shape of said rigidly arcuately shaped sheet stack supporting surface area, said repositionable sheet supporting members being automatically repositionable under the control of a controller downwardly towards said rigidly arcuately shaped sheet stack supporting surface area in response to an amount of said flimsy print media sheets being stacked on top of said repositionable sheet supporting members in excess of said preset limited amount thereof, to thereby automatically vary the stack supporting configuration of said automatically variable configuration sheet stacking tray system towards said rigidly arcuately shaped sheet stack supporting surface area.

2. The sheets stacking system of claim 1, wherein said plurality of repositionable sheet supporting members are spring loaded upwardly over areas of said rigidly arcuately shaped sheet stack supporting surface area and repositionable downwardly towards said rigidly arcuately shaped sheet stacking supporting surface area in response to a preset weight of said flimsy print media sheets stacking thereon.

3. The sheets stacking system of claim 1, wherein said plurality of repositionable sheet supporting members are repositionable downwardly towards said arcuately shaped rigid sheet stack supporting surface area in response approximately 50 to 200 of said flimsy print media sheets stacking on top of said repositionable sheet supporting members.

4. The sheets stacking system of claim 1, wherein said automatically variable configuration sheet stacking tray system has a sheet edges stacking position therein and further includes a movable sheet clamping system for automatically pressing down said flimsy print media sheets being stacked in said automatically variable configuration sheet stacking tray system adjacent to said sheet edges stacking position.

5. The sheets stacking system of claim 1, wherein said automatically variable configuration sheet stacking tray system has a sheet edges stacking position therein, and wherein at least two of said repositionable sheet supporting members are positioned adjacent to said sheet edges stacking position.

6. The sheets stacking system of claim 1, wherein said automatically variable configuration sheet stacking tray system has a first sheet edges stacking position therein, and further includes a sheet clamping system for automatically pressing down said flimsy print media sheets being stacked in said automatically variable configuration sheet stacking tray adjacent to said first sheet edges stacking position, and wherein at least two said repositionable sheet supporting members are positioned adjacent to said first sheet lead edges stacking position, and wherein at least two additional said repositionable sheet supporting members are positioned intermediately of said automatically variable configuration sheet stacking tray system.

7. The sheets stacking system of claim 6, wherein said at least two said repositionable sheet supporting members are spring loaded to be repositionable downwardly towards said rigidly arcuately shaped sheet stack supporting surface area by overcoming a preset spring force, and wherein said movable sheet clamping system for automatically pressing down said flimsy print media sheets being stacked adjacent to said first sheet edges stacking position has a pressing force which is less than said preset spring force of said at least two repositionable sheet supporting members.

8. A sheets stacking system for stacking a multiplicity of flimsy print media sheets with reduced stacking problems for curled sheets having a sheet curl axis, comprising:

an automatically variable configuration sheet stacking tray system having a substantially arcuate sheet stack supporting surface which is arcuate transversely of said sheet curl axis, and at least two spring loaded repositionable sheet stack supporting surface members spring loaded upwardly to define an initial generally planar sheet stack supporting surface by extending above the majority of said arcuate sheet stack supporting surface to define an initial sheet stack supporting surface with said repositionable sheet stack supporting surface members which is substantially more planar than said arcuate sheet stack supporting surface for supporting a preset limited amount of said flimsy printed print media sheets stacked on said repositionable sheet stack supporting surface members;

said repositionable sheet stack supporting members being automatically repositionable downwardly towards said arcuate sheet stack supporting surface in response to an amount of said flimsy printed print media sheets being stacked on said repositionable sheet supporting members in excess of said preset limited amount thereof to thereby automatically vary the stack supporting configuration of said automatically variable configuration sheet stacking tray system towards said arcuate sheet stacking supporting surface transversely of said sheet curl axis.

9. The sheets stacking system for stacking a multiplicity of flimsy print media sheets with reduced stacking problems for curled sheets of claim 8, wherein said sheets stacking system includes downwardly movable sheet stacking assistance members and at least two said repositionable sheet supporting members positioned under said downwardly movable sheet stacking assistance members.

10. The sheets stacking system for stacking a multiplicity of flimsy print media sheets with reduced stacking problems for curled sheets of claim 8, wherein said substantially arcuate sheet stack supporting surface is semi-cylindrical with a central ridge running transversely of said sheet curl axis providing a portion of said initial generally planar sheet stack supporting surface.

11. The sheets stacking system for stacking a multiplicity of flimsy print media sheets with reduced stacking problems for curled sheets of claim 8, wherein said substantially arcuate sheet stack supporting surface is semi-cylindrical with a central ridge running transversely of said sheet curl axis and providing a portion of said initial generally planar sheet stack supporting surface, and wherein at least four said repositionable sheet supporting members in approximately the same plane as said central ridge.

12. The sheets stacking system for stacking a multiplicity of flimsy print media sheets with reduced stacking problems for curled sheets of claim 8, wherein said repositionable sheet supporting members extend upwardly through apertures in said substantially arcuate sheet stack supporting surface.

13. A method of stacking a multiplicity of flimsy print media sheets on a sheet stacking surface with at least some of said sheets having sheet curl in a sheet curl direction; comprising:

automatically changing the effective shape of said sheet stacking surface from a first approximately planar stack supporting shape for an initially stacked amount of said flimsy print media sheets to a second and substantially arcuately curved stack supporting shape for a second and substantially greater stacked amount of said flimsy print media sheets, arcuately deforming said second and substantially stacked amount of said flimsy print media sheets transversely of said sheet curl direction with said second arcuately curved stack supporting shape extending transversely of said sheet curl direction, and significantly reducing the total amount of said sheet curl in said substantially greater stacked amount of said flimsy print media sheets.

14. A method of stacking flimsy sheets presenting stacking problems for curled sheets comprising:

stacking said sheets in an automatically variable configuration stacking system having a spaced plurality of upstanding repositionable initial sheet supporting surfaces providing a roughly planar initial stack supporting configuration, stacking an initial limited amount of said sheets on at least some of said plurality of upstanding repositionable initial sheet supporting surfaces, and then, in response to stacking additional said sheets in said automatically variable configuration stacking system in excess of said initial limited amount of said sheets, automatically changing said automatically variable configuration stacking system to a different, arcuate, stack supporting configuration by automatically lowering at least some of said plurality of upstanding repositionable initial sheet supporting surfaces to arcuately bend said stacked sheets in an arcuate direction transversely of the direction of sheet curl.

15. A method of stacking a multiplicity of flimsy print media sheets outputted from a printer as printed sheets with sheet curl, comprising:

stacking said flimsy printed print media sheets into an automatically variable configuration stacking system, stacking a preset initial limited amount of said flimsy printed print media sheets in said automatically variable configuration stacking system on top of a generally planar spaced array of plural repositionable sheet supporting surfaces in said automatically variable configuration stacking system, in response to stacking additional said flimsy printed print media sheets in said automatically variable configuration stacking system substantially in excess of said preset initial limited amount of said flimsy printed print media sheets, automatically changing said automatically variable configuration stacking system to an arcuate stack supporting surface configuration by automatically lowering at least some of said spaced array of plural repositionable sheet supporting surfaces.

16. The method of stacking a multiplicity of flimsy printed print media sheets of claim 15, including:

depressing said spaced array of plural repositionable sheet supporting surfaces automatically towards an underlying arcuately shaped rigid sheet supporting surface area of said automatically variable configuration stacking systems, and bending said flimsy printed print media sheets stacked substantially into said arcuate shape of an arcuately shaped rigid sheet supporting surface area.

17. The method of stacking a multiplicity of flimsy printed print media sheets of claim 15, including:

depressing said spaced array of plural repositionable sheet supporting surfaces that are spring loaded automatically towards an underlying arcuately shaped rigid sheet supporting surface area of said automatically variable configuration stacking system, and bending said flimsy printed print media sheets stacked substantially into said arcuate shape of substantially underlying arcuately shaped rigid sheet supporting surface areas of said variable configuration stacking system by the weight of said stacking of said flimsy printed print media sheets in said automatically variable configuration stacking system substantially in excess of a preset initial limited stack weight of said flimsy printed print media sheets.

18. The method of stacking a multiplicity of flimsy printed print media sheets of claim 15, including:

feeding said flimsy printed print media sheets into said automatically variable stacking system with sheet curl in a first direction, wherein said automatically variable stacking system has an arcuately shaped rigid sheet supporting surface area which is arcuately shaped transversely of said first direction, and wherein said spaced array of plural repositionable sheet supporting surfaces extend transversely of said arcuately shaped sheet supporting surface area to be normally at least partially spaced above said arcuately shaped rigid sheet supporting surface area, depressing said spaced array of plural repositionable sheet supporting surfaces automatically in response to said stacking thereon of said flimsy printed print media sheets substantially exceeding said preset limited initial amount of said flimsy printed print media sheets, forming an arcuately shaped stack supporting surface which is arcuate transversely of said first direction of sheet curl, and bending with gravity said stacked printed print media sheets towards said rigidly arcuately shaped rigid sheet stacking supporting surface area.

19. The method of stacking a multiplicity of flimsy printed print media sheets of claim 15, wherein said automatically variable configuration sheet stacking tray has a first sheet edges stacking position therein, and further includes a movable sheet clamping system for automatically pressing down said flimsy printed print media sheets adjacent to said first sheet edges stacking position, and wherein at least two of said repositionable sheet supporting surfaces are positioned adjacent to said first sheet edges stacking position.

* * * * *